US009855456B2

(12) United States Patent
Dorsey et al.

(10) Patent No.: US 9,855,456 B2
(45) Date of Patent: Jan. 2, 2018

(54) INTERCHANGEABLE ROTATING FREE-MOTION FITNESS HANDLE SYSTEM

(71) Applicant: Kevin Dorsey, Madison, WI (US)

(72) Inventors: Kevin Dorsey, Madison, WI (US); Adam D. Schumacher, Chicago, IL (US); David P. Rossi, Glen Ellyn, IL (US)

(73) Assignee: Kevin Dorsey, Madison, WI (US)

( * ) Notice: Subject to any disclaimer, the term of this patent is extended or adjusted under 35 U.S.C. 154(b) by 0 days.

(21) Appl. No.: 15/470,275

(22) Filed: Mar. 27, 2017

(65) Prior Publication Data

US 2017/0282000 A1 Oct. 5, 2017

Related U.S. Application Data

(63) Continuation-in-part of application No. 14/466,415, filed on Aug. 22, 2014, now abandoned.

(60) Provisional application No. 61/868,769, filed on Aug. 22, 2013.

(51) Int. Cl.

| | |
|---|---|
| ***A63B 23/12*** | (2006.01) |
| ***A63B 21/04*** | (2006.01) |
| ***A63B 21/055*** | (2006.01) |
| ***A63B 21/16*** | (2006.01) |
| ***A63B 21/00*** | (2006.01) |

(52) U.S. Cl.
CPC ..... *A63B 21/0442* (2013.01); *A63B 21/0557* (2013.01); *A63B 21/1663* (2013.01); *A63B 21/4013* (2015.10); *A63B 21/4021* (2015.10); *A63B 21/4035* (2015.10)

(58) Field of Classification Search
CPC . A63B 21/0552; A63B 21/14; A63B 21/1403; A63B 21/1446; A63B 21/1453; A63B 21/148; A44B 19/00–19/42
See application file for complete search history.

(56) References Cited

U.S. PATENT DOCUMENTS 843,478 A * 2/1907 Muller ..... A63B 21/0552 482/124
3,355,171 A * 11/1967 Oesan ..... A63B 21/0023 482/91

* cited by examiner

*Primary Examiner* — Rae Fischer
(74) *Attorney, Agent, or Firm* — Woodard, Emhardt, Moriarty, McNett & Henry, LLP; Charles Meyer

(57) ABSTRACT

A fitness handle which is used as an exercise device that allows a resilient cord or tube to move in a linear direction in order to maintain consistent resistance. The fitness handle includes a grip and a frame. The frame includes an opening which allows the cord to slide. The cord or tube has an adjoining portion which fits into the opening of the handle.

14 Claims, 13 Drawing Sheets

INTERCHANGEABLE ROTATING FREE-MOTION FITNESS HANDLE SYSTEM

CROSS REFERENCE TO RELATED APPLICATIONS

The present patent document is a continuation-in-part of U.S. patent application Ser. No. 14/466,415 filed on Aug. 22, 2014, which claims the benefit of the filing date under 35 U.S.C. §119(e) of Provisional U.S. patent application Ser. No. 61/868,769, filed Aug. 22, 2013, and which are hereby incorporated by reference in their entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present disclosure relates generally to exercise devices and methods, and more particularly, to exercise devices and methods relating to resistance training.

2. Description of Related Art

Resistance training is often considered an essential component of any fitness program. A variety of different types of equipment are available for resistance training including free weights, weight machines, resistance bands, etc. Many people prefer using resistance bands/stretchable cords because of their ease of use and portability. Resistance bands generally include handle(s) and a stretchable cord. However, current devices have a fixed point which can limit the exercises a user can perform. Furthermore, current devices are prone to error and thus do not provide consistent and accurate resistance. Additionally, the fixed point can create stress on the cable over time.

SUMMARY

In accordance with the present disclosure, interchangeable rotating free-motion fitness handle systems that may be used by individuals for exercise/physical fitness purposes such as resistance training, and methods for creating them are illustrated and described herein.

In one example of an interchangeable and rotational resistance tube handle system, a handle used as an exercise device ("fitness handle") which allows a resilient cord or tube anchor to move or pan in a linear direction in a channel in order to maintain consistent resistance is disclosed. The fitness handle doesn't require a fixed point for the resistance tube. The fitness handle includes a grip and a frame. The frame includes an opening which allows the cord anchor to slide. The cord/tube/etc. has an adjoining portion which fits into the opening of the handle.

In another embodiment, a hinge-locking tube anchor and pulley system is disclosed. The mechanism may allow users to create an anchor point from which they are able to generate resistance using resistance tubes. Key features can include, but are not limited to, the outer ends of a component which allow sewn webbing loop, or suitable design, to be applied and removed from the component when the webbing is not under tension.

It should be noted that this disclosure should not be limited to the embodiments disclosed herein. A variety of other embodiments are also possible using the concepts enclosed herein.

DESCRIPTION OF PREFERRED EMBODIMENTS

Figure 1:
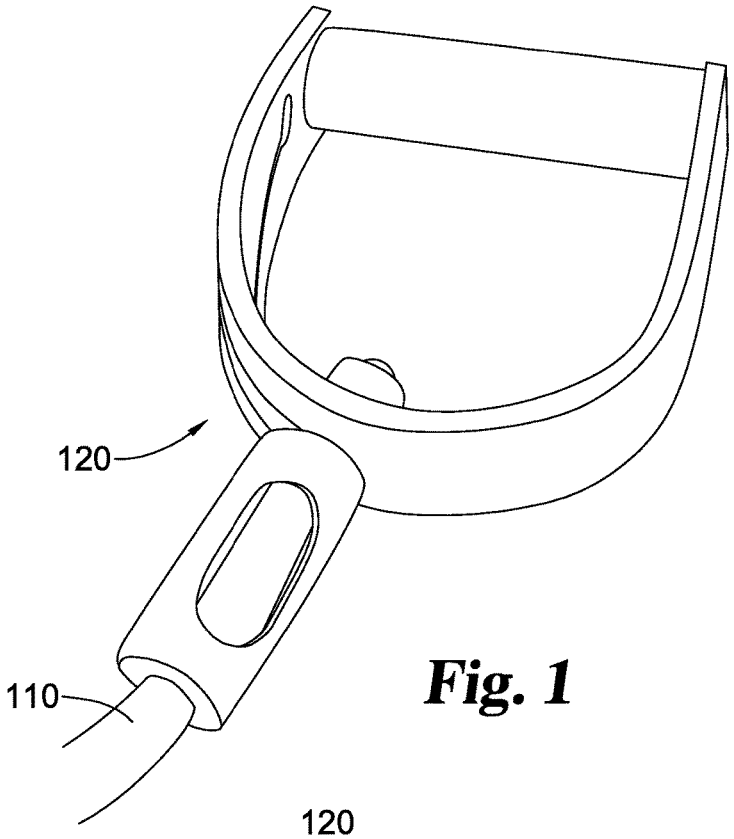
FIG. 1 illustrates an embodiment of an interchangeable rotating free-motion fitness handle system.

Reference will now be made to the accompanying drawings, which form a part hereof, and which show, by way of illustration, specific exemplary embodiments. The principles described herein may, however, be embodied in many different forms. The components in the figures are not necessarily to scale, emphasis instead being placed upon illustrating the principles of the invention. In some instances, example measurements are mentioned merely as illustrations of one or more embodiments and not to restrict the invention. Moreover, in the figures, like referenced numerals may be placed to designate corresponding parts throughout the different views.

An interchangeable rotating free-motion fitness handle system may provide more accurate and consistent results because the tube/cord is always stretching linearly and thus, it's not manipulated by a fixed point. Additional muscles can be targeted by using the rotational features.

In one example of an interchangeable rotating free-motion fitness handle system, a fitness handle that features an opening "oculus" that permits a resistance tube anchoring mechanism to enter into a sliding channel such that when combined with a rotational-hand-grip, allows a fitness resistance tube equipped with a resistance tube anchoring mechanism to both pan left and right, and optionally hinge up and down as users move through exercise motions is disclosed. A "barb" that may be located next to the oculus prevents the resistance tube anchoring mechanism from exiting the sliding channel when under any tension.

A resistance tube anchoring mechanism can be a mechanism that is applied to the tail end(s) of plugged resistance tubes which allows for the tubes to be connected to tube accessories including interchangeable handle(s) and any appropriate accessories. Such accessories may be equipped with, for example, a button-style fabric tube anchor point (see FIG. 12 for example). Of course, the length and resistance characteristics of the cables/stretch tubes the resistance tube anchoring mechanism is applied to can vary depending on the needs of the user.

A hinge-locking tube anchor and pulley system may be a mechanism that allows users to create an anchor point from which they are able to generate resistance using resistance tubes. Key features can include, but are not limited to, the outer ends of a component which allow sewn webbing loop, or suitable design, to be applied and removed from the component when said webbing is not under tension. The component may be made of, but of course is not limited to, plastic. Other suitable materials may be also be used.

When under tension, the webbing loops may secure the component as an anchor point, while allowing it to rotate, creating a pulley which responds to torsion friction applied by the fitness tube, thereby reducing wear/damage to the tube. This removable webbing loop design allows the hinge-locking tube anchor and pulley system to be secured to door hinges to create a superiorly secure anchor point, regardless of user orientation to the door. This allows the system to work on both open and closed doors, and offers the convenience of remaining in place when not in use, if the user so chooses. One additional feature is the larger pulley guide fins that define the outer limits of the pulley space. These large fins respond to pressure coming from the resistance tube, when in use, and adjust the orientation of the pulley to minimize wear on the tubes as different exercise movements are performed.

A button-lock ankle/wrist attachment allows a sewn or otherwise connected cuff to be attached to body regions of the user without requiring hand-grip. A key feature is the sewn button lock (slit) which receives the resistance tube anchoring mechanism and holds it securely when under tension, similar to the manner a shirt button behaves. The length of fabric between the sewn button lock and the sewn attachment point to the cuff creates a flexible 'hinge' which allows the system to remain secure as orientation to the tube forces change.

Referring to FIG. 1, an exemplary embodiment of an interchangeable rotating free-motion fitness handle system is illustrated. Interchangeable rotating free-motion fitness handle system includes cable/stretch tube/resistance band ("fitness tube") 110 and interchangeable and rotational fitness handle system 120.

Figure 2:
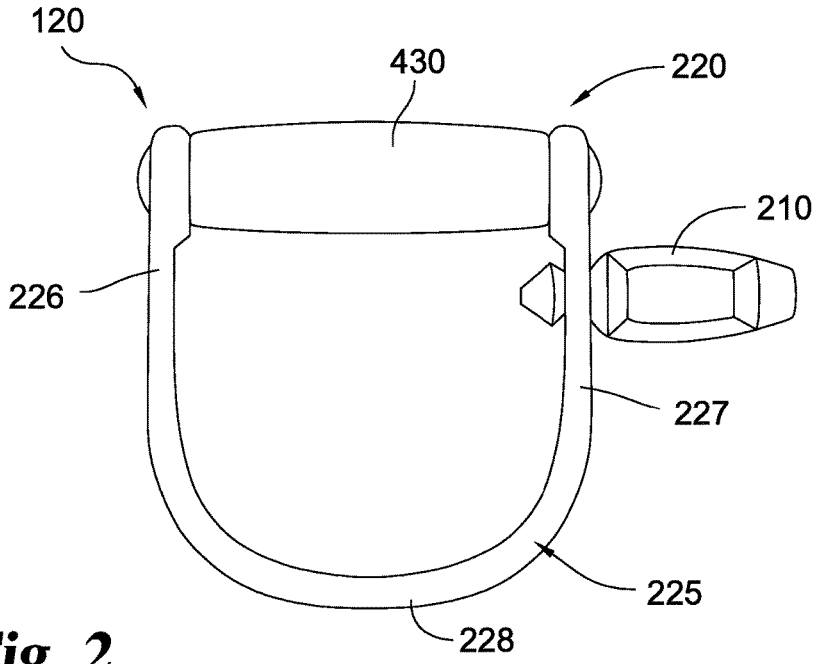
FIG. 2 illustrates a front view of interchangeable rotating free-motion fitness handle system of FIG. 1.

FIG. 2 illustrates the components of an interchangeable rotating free-motion fitness handle system. FIG. 2 includes an exemplary stretch tube/resistance band 110, anchoring mechanism, such as anchor 210, and fitness handle 220. Flat slide surface 211 of anchoring mechanism 210 is also illustrated.

Fitness handle 220 includes a curved frame 225. Curved frame 225 has a length and two opposing side portions 226, 227. Each of the side portions 226, 227 have a length and are parallel to each other along the majority of their length. An arcuate portion 228 extends between an end of each of the opposing side portions 226, 227. A grip 430 is positioned between the opposing ends of opposing side portions 226, 227 of frame 225. Grip 430 may be rotatable.

Figure 3:
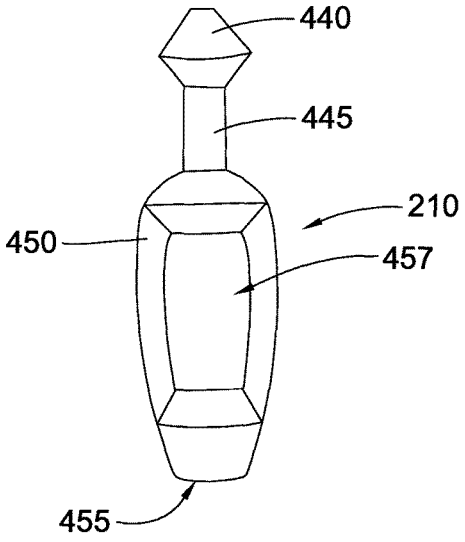
FIG. 3 illustrates a side view of the anchoring mechanism from the interchangeable rotating free-motion fitness handle system of FIG. 1.

FIG. 3 illustrates an embodiment of an anchoring mechanism 210. Anchoring mechanism 210 includes a barb 440, a neck 445, and a connection portion 450. Neck 445 is positioned between and connects barb 440 to connection portion 450. As shown, barb 440 has a width that is greater than the width of neck 445.

Figure 4:
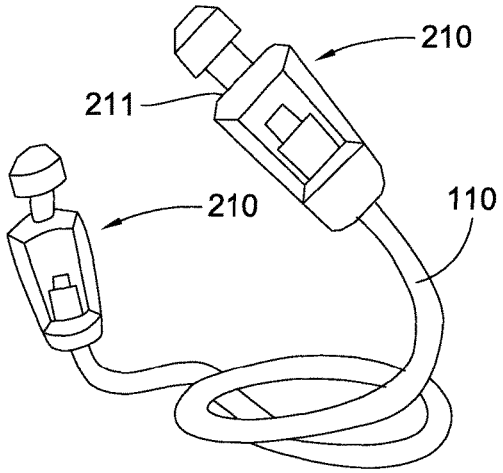
FIG. 4 illustrates a resistance component attached to two anchors from the interchangeable rotating free-motion fitness handle system of FIG. 1.
Figure 5:
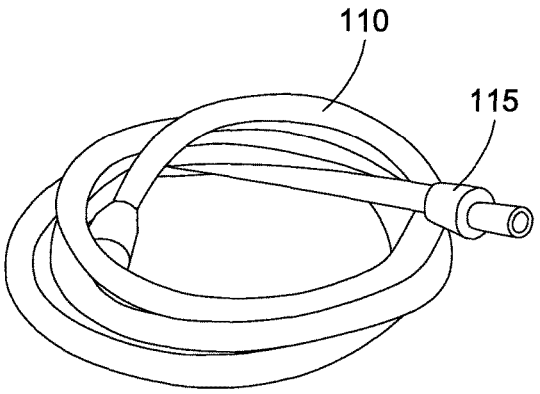
FIG. 5 illustrates a resistance component from FIG. 4.

As shown in FIG. 4, connection portion 450 may receive a resistance component 110 to attach resistance component 110 to anchoring mechanism 210. One or both ends of resistance component 110 include a protruding part 115 that has a diameter that is greater than the diameter of resistance component 110 (see FIG. 5). An end of resistance component 110 that includes protruding part 115 may be inserted into connection portion 450 of an anchoring mechanism 210.

Connection portion 450 includes a connection opening 455 (also see FIG. 6A) and a cavity 457 that may receive resistance component 110. When resistance component extends through connection opening 455, protruding part 115 is positioned within cavity 457. The diameter of protruding part 115 is greater than the diameter of connection opening 455 so protruding part 115 prevents resistance component 110 from being removed from connection portion 450 when tension is applied to resistance component 110.

Figure 6A:
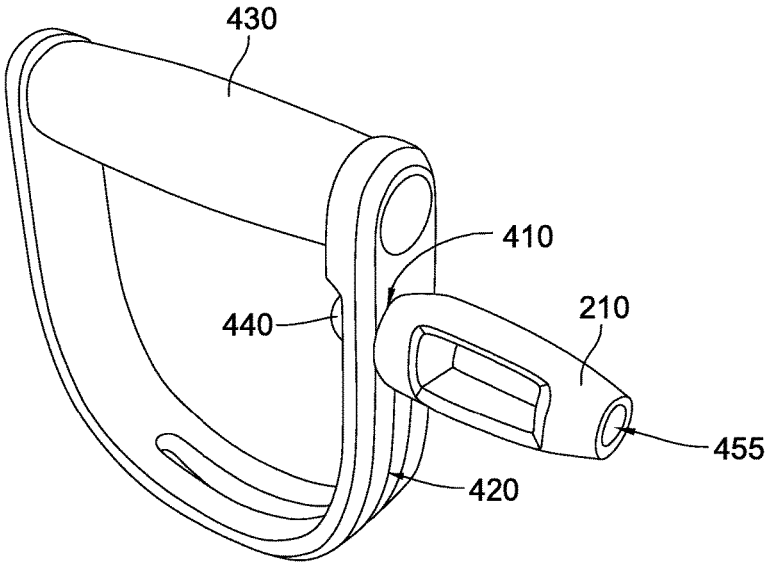
FIG. 6A illustrates a right perspective view of one embodiment of a fitness handle and anchoring mechanism.
Figure 6B:
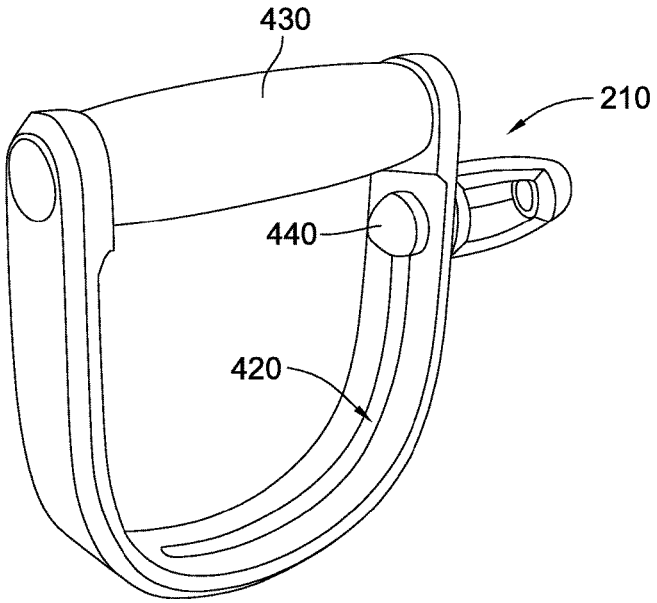
FIG. 6B illustrates a left perspective view of one embodiment of the fitness handle and anchoring mechanism from FIG. 6A.

FIGS. 6A-6B illustrate various views of an embodiment of fitness handle system 120. Referring briefly to FIG. 6A, an oculus, such as opening 410 (see FIG. 7B), allows the anchoring mechanism 210 to enter into a sliding channel 420 such that when combined with a rotational-hand grip 430 allows a fitness tube to both pan left and right, as well as hinge up and down as users move through exercise motions.

Anchoring mechanism 210 is positioned within opening 410 so that barb 440 is positioned interior to one of the side portions 226, 227 of frame 225, while connection portion is exterior to the side portion 226, 227. Barb 440 can prevent the anchoring mechanism 210 from exiting sliding channel 420 when under tension. Neck 445 is positioned in sliding channel 420 and has a width that is smaller than the width of sliding channel 420 so anchoring mechanism 210 may slide within sliding channel 420.

Figure 7A:
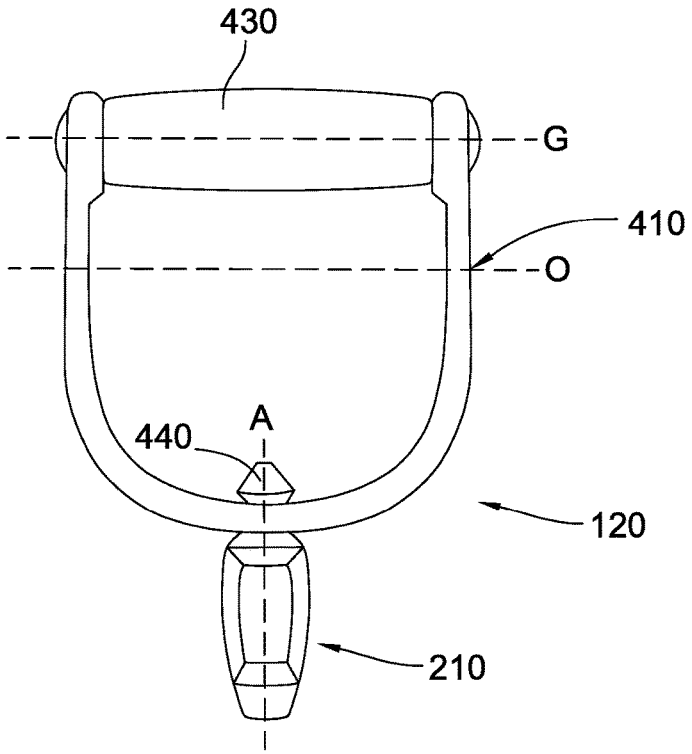
FIG. 7A illustrates a front view of an interchangeable rotating free-motion fitness handle system.
Figure 7B:
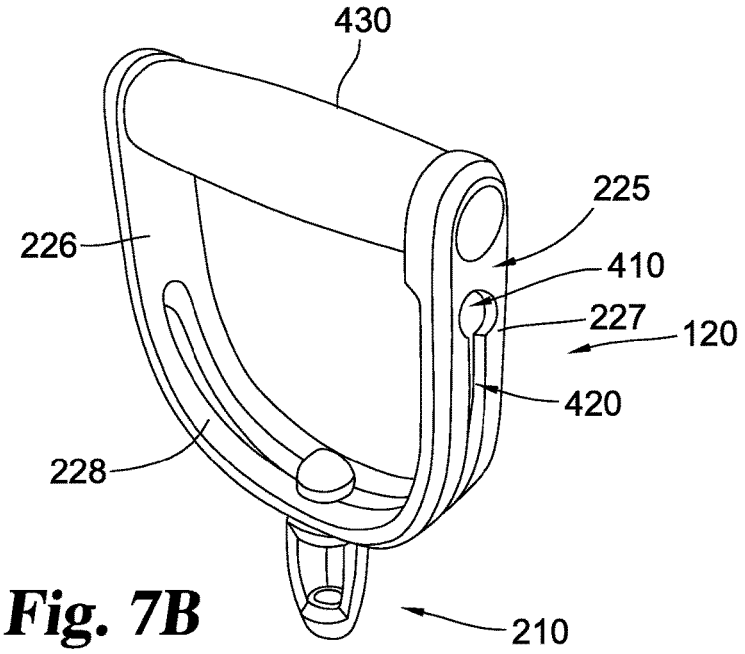
FIG. 7B illustrates a side view of the interchangeable rotating free-motion fitness handle system from FIG. 7A.

FIGS. 7A-7B illustrate fitness handle system 120 after anchoring mechanism 210 has moved along sliding channel 420 so anchoring mechanism 210 is positioned along the arcuate portion 228 of handle 220. As shown in FIG. 7B, opening 410 forms one end of sliding channel 420. Opening 410 has a diameter that is greater than the width of sliding channel 420.

In some embodiments, sliding channel 420 may extend in different lengths along frame 225. For example, in FIG. 6A, sliding channel 420 begins in side portion 227 and extends along a portion of arcuate portion 228, but does not extend to side portion 226. Alternately, as shown in FIG. 7B, sliding channel 420 may extend along the entirety of arcuate portion 228 of frame 225 and extend along a portion of side portion 226.

FIG. 7A also illustrates a grip axis G defined longitudinally through hand grip 430, an oculus axis O defined through opening 410, and an anchor axis A defined through anchoring mechanism 210. As shown, grip axis G is substantially parallel to oculus axis O. When anchoring mechanism 210 is positioned in opening 410, anchor axis A is parallel to grip axis G and oculus axis O. However, anchoring mechanism 210 may be slid along sliding channel 420 so that the angle of anchor axis A with respect to grip axis G and oculus axis O may be changed.

Figure 8A:
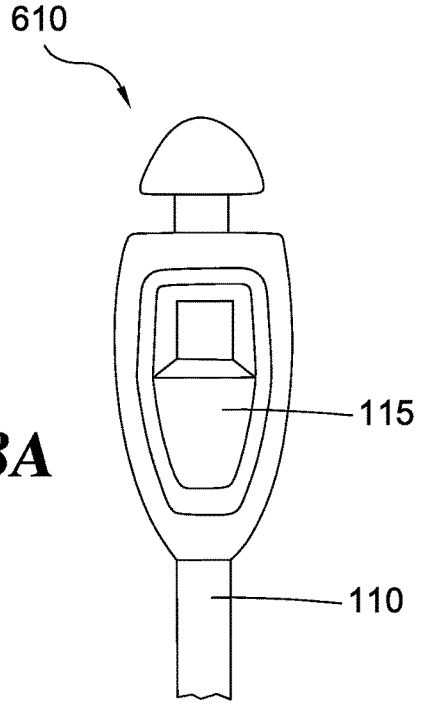
FIG. 8A illustrates a front view of an embodiment of an anchor.
Figure 8B:
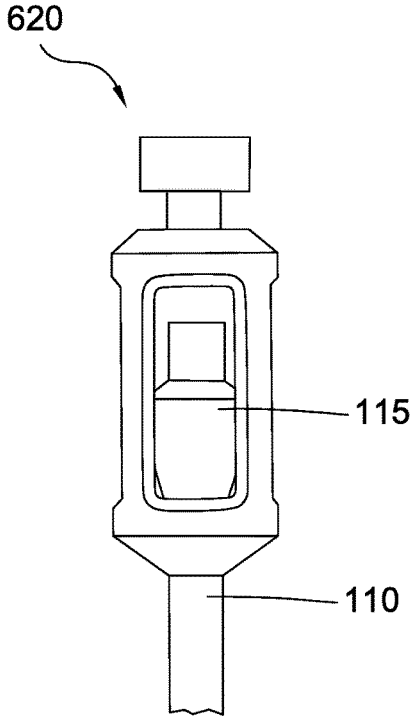
FIG. 8B illustrates a front view of an embodiment of an anchor.
Figure 8C:
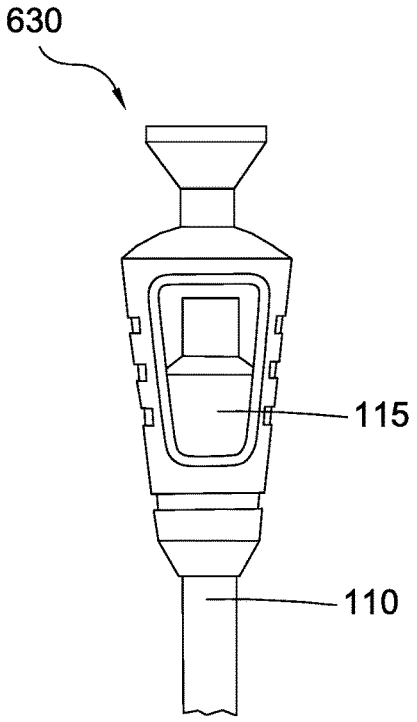
FIG. 8C illustrates a front view of an embodiment of an anchor.

FIGS. 8A-8C illustrate several embodiments of anchoring mechanism 210 including pill 610, barrel 620, and cone 630. As can be seen, fitness tube 110 can be inserted into the anchoring mechanisms 610, 620, and 630.

Figure 9A:
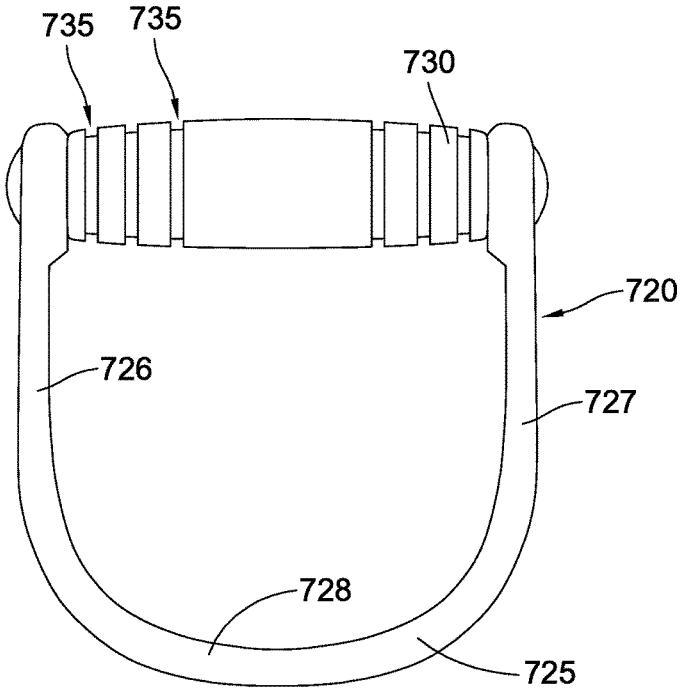
FIG. 9A illustrates a front view of an embodiment of a handle.

FIG. 9A illustrates an alternative embodiment of a fitness handle 720. Fitness handle 720 includes a curved frame 725 having opposed side portions 726, 727 and an arcuate portion 728. Handle 720 also includes a handgrip 730 with texture provided by grooves 735. Handgrip 730 is positioned between opposing ends of side portions 726, 727. In some embodiments, handgrip 730 may be rotatable with respect to frame 725. In some embodiments, as representative dimensions, handgrip 730 may have a length of 4.5 inches. Likewise, the ends of opposing side portions 726, 727 and handgrip 730 may have a front to rear width or outer diameter of 1.5 inches. The side portions may include a tapered portion that decreases the width of the ends of side portions 726, 727 to 1.25 inches, for example to receive an end of connection bar 940 or a clip lock 910 (see FIG. 11).

Figure 9B:
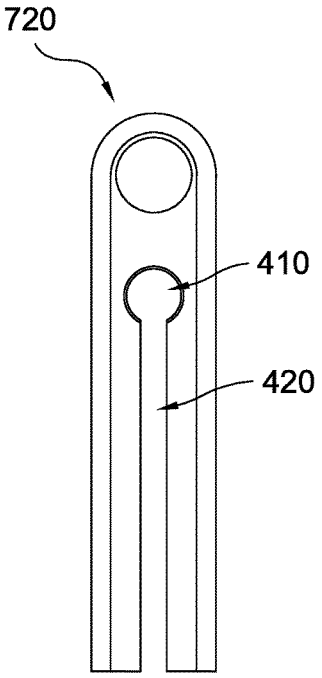
FIG. 9B illustrates a side view of the handle of FIG. 9A.

As shown in FIG. 9B, in some embodiments, handle 720 may include opening 410 and sliding channel 420. Sliding channel may extend from opening 410 along the majority of the length of side portion 727 and arcuate portion 728, and along at least a portion of side portion 726.

Figure 10:
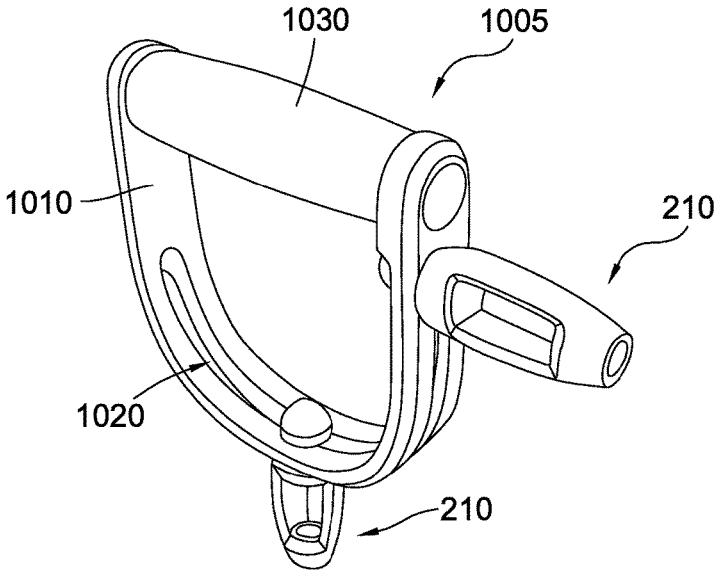
FIG. 10 illustrates a perspective view of an embodiment of a handle of the interchangeable rotating free-motion fitness handle system of FIG. 1.

FIG. 10 illustrates an embodiment of an interchangeable rotating free-motion fitness handle system 1005. Handle system 1005 includes a curved frame 1010 including opposing sides and a sliding channel 1020 defined through a portion of the length of frame 1010. A handgrip 1030 is attached between the opposing sides of frame 1010. A pair of anchoring mechanisms 210 engage the sliding channel 1020 so that anchoring mechanisms 210 are slidable within channel 1020. Alternately, multiple anchoring mechanisms could be used. As shown in FIG. 10 anchoring mechanisms 210 may slide independently so each anchoring mechanism 210 may be positioned at a different location along the frame 1010. Each anchoring mechanism 210 may receive a resistance component or resistance component end so that multiple resistance components or two ends of the same resistance component may be attached to handle system 1005.

Figure 11:
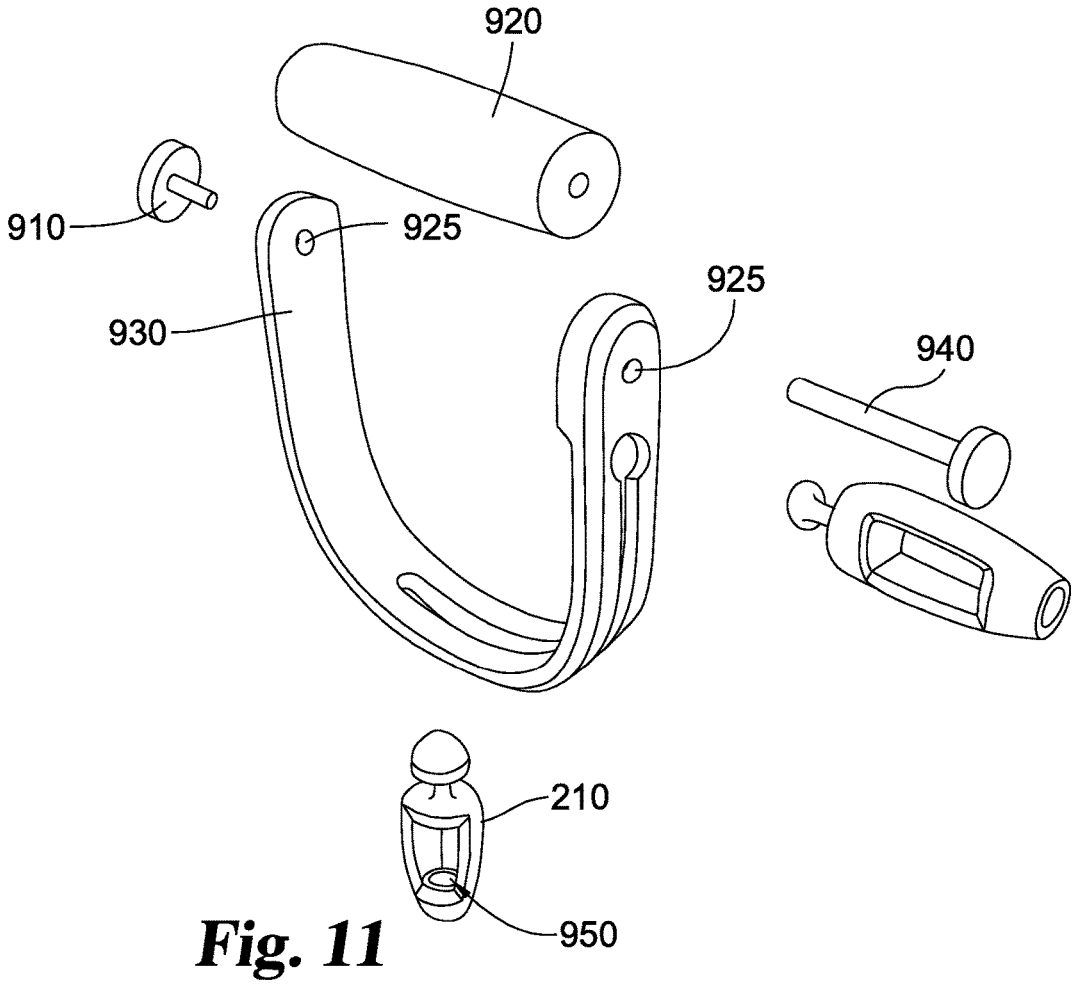
FIG. 11 illustrates an exploded view of the components of an embodiment of an interchangeable rotating free-motion fitness handle system.

FIG. 11 illustrates a more detailed view of the components of an embodiment of an interchangeable rotating free-motion fitness handle system. This embodiment of an interchangeable rotating free-motion fitness handle system includes clip lock 910, plastic grip with TPR overmold 920, frame/main body 930, connection bar 940 and anchoring mechanism 210. Plastic grip overmold 920 may be positioned between opposing sides of frame 930 and aligned with grip openings 925 defined in frame 930. Connection bar 940 may be inserted through one grip opening 925, then through plastic grip overmold 920, and then through the other grip opening 925 to attach plastic grip overmold 920 to frame 930 while allowing grip overmold 920 to rotate. Clip lock 910 attaches to the end of connection bar 940 and prevents connection bar 940 from being removed from grip openings 925. Plastic grip with TPR overmold 920 may provide a comfortable grip to a user and may not be required. While this embodiment uses a plastic grip with TPR overmold, numerous alternative grips are also possible within the scope of the invention. The anchoring mechanism 210 includes resistance band insert 950 for inserting a resistance band. Clip lock 910 may be made from a variety of different materials. In one embodiment clip lock 910 is made of plastic. Other materials may be used within the scope of the invention. Additionally, any specific measurements in this figure and others are illustrated to assist in the understanding of the invention and not to restrict or in any way limit the invention.

Figure 12:
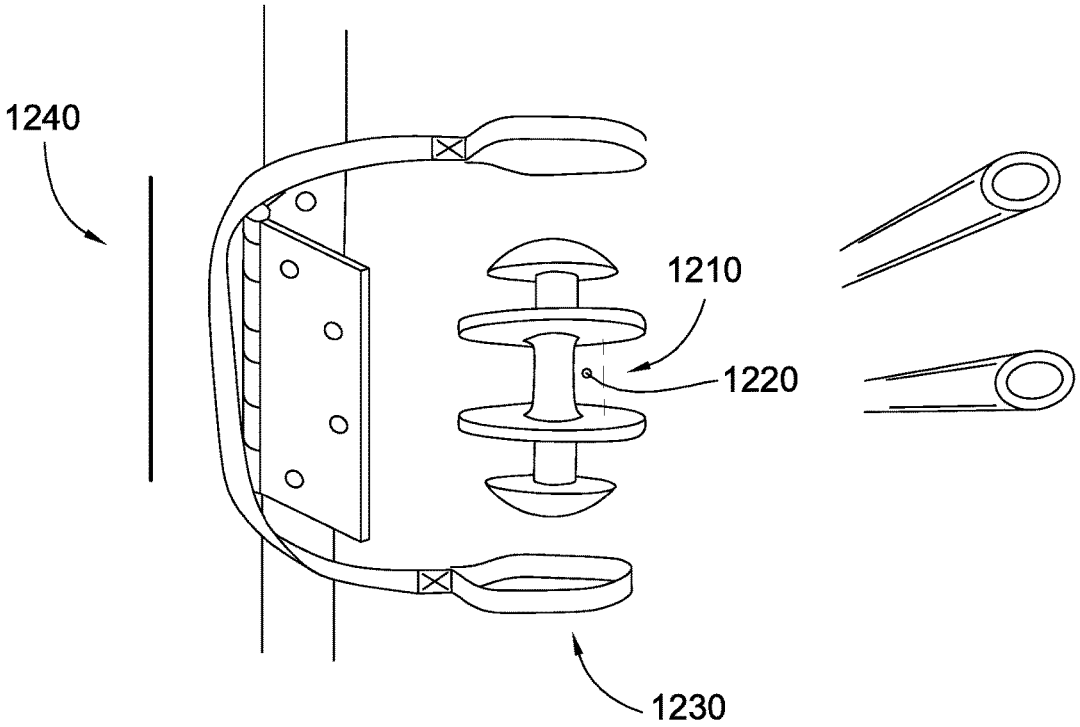
FIG. 12 illustrates an embodiment of a hinge-locking tube anchor and pulley system.

FIG. 12 illustrates one embodiment of a fitness cable anchor and pulley system. Multi cable pulley 1210 may be designed such that it is wear reducing, thus increasing the life of the system. A rib 1220 may be added for strength purposes. Loop 1230 may "lock" onto the pulley 1210 contour when under tension, and may completely encompass the hinge for added safety. Loop 1230 may be sewn. The material of loop 1230 may be made of nylon but any other suitable material can also be used. The system may be used on both sides of the door 1240. For example, an open door install may be configured to stay up when the door is opened or not in use.

Figure 13A:
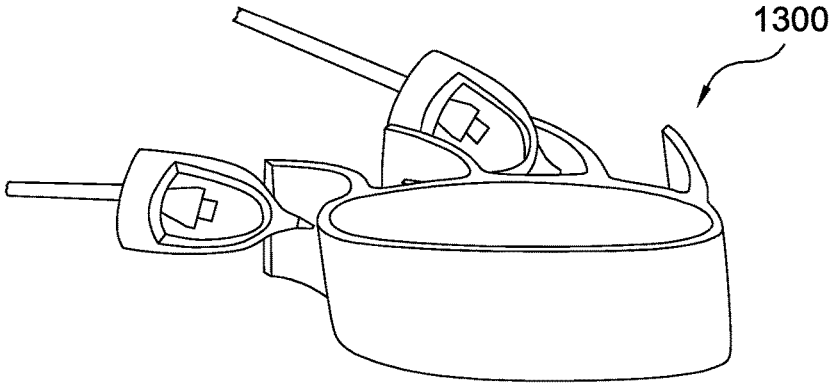
FIG. 13A illustrates an embodiment of a button lock ankle/wrist attachment.
Figure 13B:
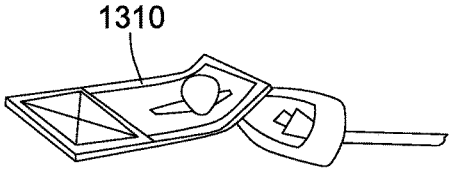
FIG. 13B illustrates an embodiment of a webbing cable attachment.
Figure 13C:
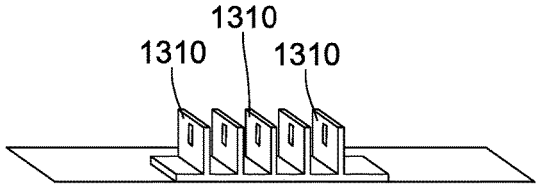
FIG. 13C illustrates an embodiment of a webbing cable attachment.
Figure 14A:
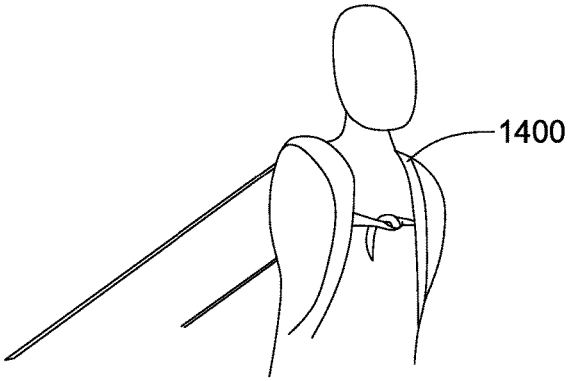
FIG. 14A illustrates an embodiment of a multi-attachment point fitness harness.
Figure 14B:
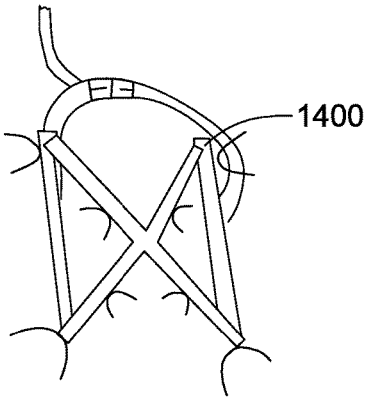
FIG. 14B illustrates an embodiment of a multi-attachment point fitness harness.
Figure 15:
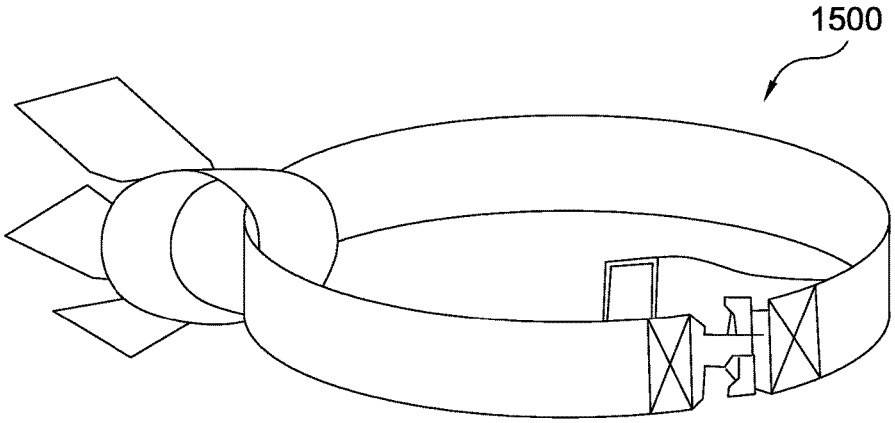
FIG. 15 illustrates an embodiment of a fitness harness.

FIGS. 13A-13C illustrate one embodiment of a button lock ankle/wrist attachment. In this embodiment, a Velcro strap with a soft-inner-backer is used. FIGS. 14A-14B illustrate one embodiment of a multi-attachment point fitness harness. FIG. 15 illustrates one embodiment of a 360 degree rotating fitness harness.

Figure 16:
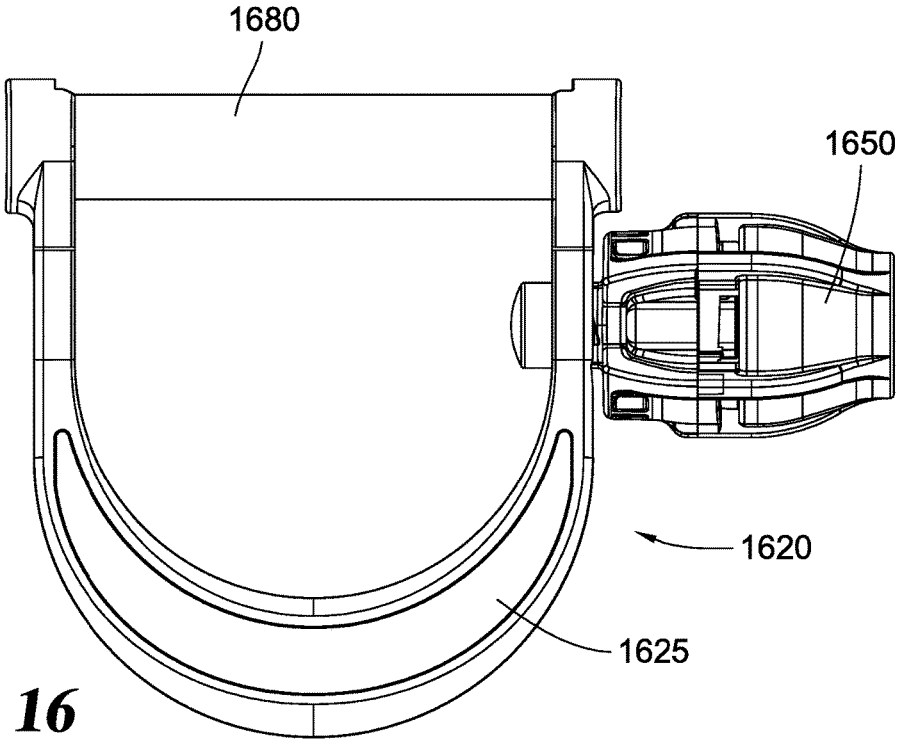
FIG. 16 illustrates a front view of an embodiment of a handle system.

FIG. 16 shows an alternative embodiment of a handle 1620. Handle 1620 includes an anchor 1650 and a grip 1680 extending between opposing sides of frame 1625.

Figure 17:
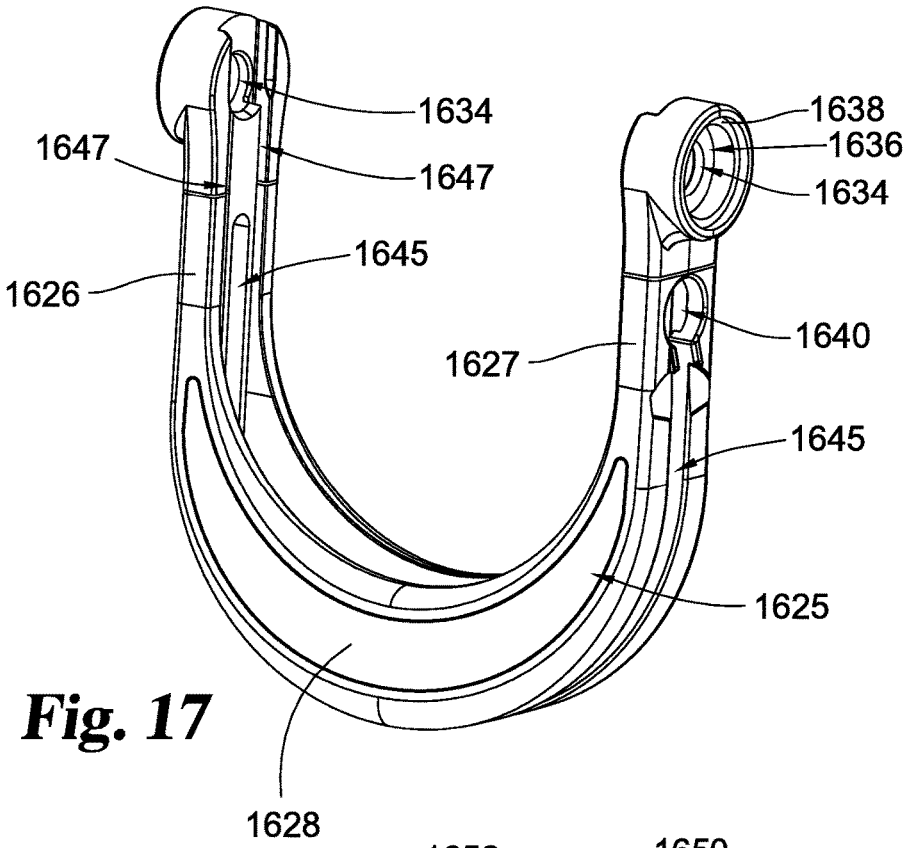
FIG. 17 illustrates a perspective view of a handle from the handle system of FIG. 16.

FIG. 17 shows a perspective view of a handle frame 1625. Handle frame 1625 has two opposing side portions 1626, 1627 extending from an arcuate portion 1628 to form a horseshoe shape. Each of the side portions 1626, 1627 has a length, and side portions 1626, 1627 are parallel to each other along the majority of their length. In other embodiments, other frame geometries may be used.

One end of side portion 1626 includes a grip opening 1634 for receiving an end of grip 1680. The opposing end of side portion 1627 includes a corresponding and axially aligned grip opening 1634 for receiving the other end of grip 1680. Each grip opening 1634 opens into a grip cavity 1636 that includes a ledge 1638.

An opening, such as oculus 1640, is defined in side portion 1627. Oculus 1640 forms an end of a sliding channel 1645 defined in frame 1625 and provides an introduction point for anchor 1650. The diameter of oculus 1640 is larger than the width of sliding channel 1645. Oculus 1640 is large enough to allow a portion of anchor 1650 to be inserted through oculus 1640. Although oculus 1640 is shown in side portion 1627 adjacent to grip 1680, in other embodiments, oculus 1640 may be defined through side portion 1626 or in other locations along handle frame 1625. Optionally, oculus 1640 is spaced away from the area where anchor 1650 is located and used during most exercises.

Sliding channel 1645 extends along at least a portion of the length of frame 1625. In some embodiments, sliding channel extends from side portion 1627, through the entirety of arcuate portion 1628, and along side portion 1626 for a length that is approximately equal to the length at which sliding channel 1645 is defined through side portion 1627. In other embodiments, the length of sliding channel 1645 may be varied as desired. For example, sliding channel 1645 may extend from side portion 1627 and along only a part of arcuate portion 1628. In one embodiment, the end of channel 1645 may be located at a midpoint of the arcuate portion, providing a hard stop.

In some embodiments, grooves 1647 may extend adjacent the length of sliding channel 1645 on the interior side of frame 1625. A portion of anchor 1650 may be configured to fit within grooves 1647 to keep anchor 1650 within sliding channel 1645 as anchor 1650 slides within channel 1645.

Figure 18:
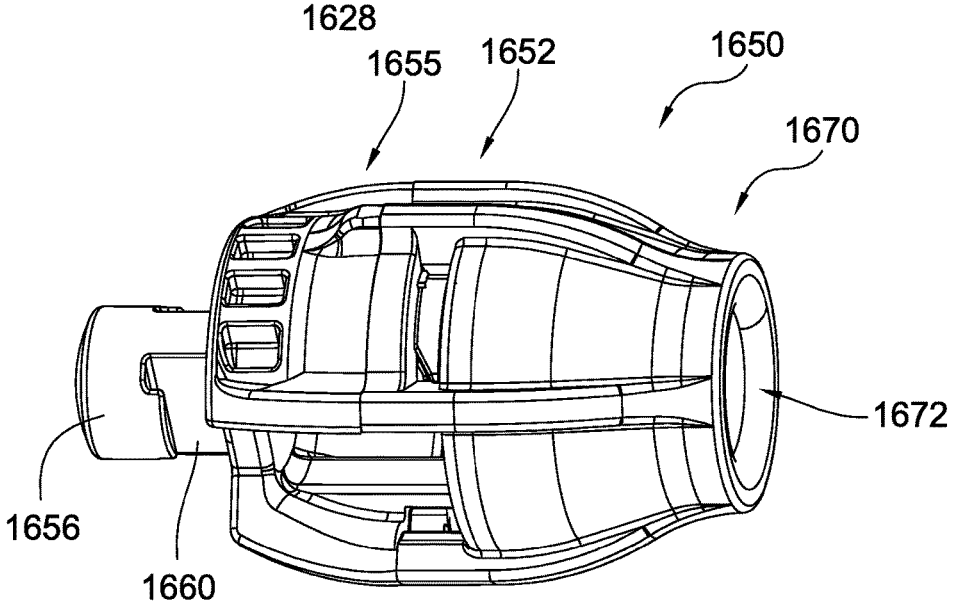
FIG. 18 illustrates a perspective view of an anchor of from the handle system of FIG. 16.

An embodiment of anchor 1650 is shown in FIG. 18. Anchor 1650 includes a connection portion 1652 that is formed from a top receiver 1655 and a bottom receiver 1670. A neck 1660 extends from top receiver 1656 and connects to a barb 1656 that is dimensioned to fit through oculus 1640. An anchor opening 1672 is defined in bottom receiver 1670 and leads to an anchor cavity 1674 (see FIG. 20) that is formed between top receiver 1656 and bottom receiver 1670.

Figure 19:
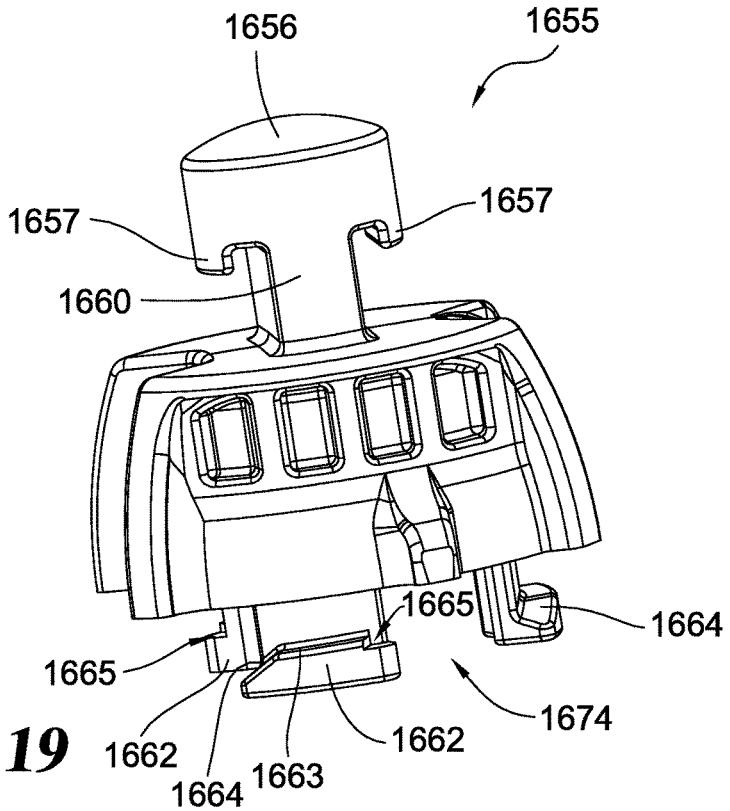
FIG. 19 illustrates a perspective view of a top receiver from the anchor of FIG. 18.

A perspective view of top receiver 1656 is shown in FIG. 19. As shown, top receiver 1655 includes a barb 1656 and a neck 1660 connecting barb 1656 to top receiver 1655. The side of top receiver 1655 opposite barb 1656 includes several tabs 1662 arranged around the circumference of top receiver 1655. Each tab 1662 includes a projection 1663. Projection 1663 includes a tapered portion 1664 that facilitates projection 1663 entering a slot 1677 in bottom receiver 1670 (see FIG. 20). A step portion 1665 helps to lock top receiver 1655 to bottom receiver 1670 when tab 1662 engages an overhang 1678.

Barb 1656 is dimensioned to fit through oculus 1640, while neck 1660 has a smaller width than barb 1656 so that neck 1660 may fit within sliding channel 1645. When anchor 1650 is attached to frame 1625, neck 1645 is within sliding channel 1645 to allow anchor 1650 to slide along the length of sliding channel 1645 by panning left and right.

In some embodiments, barb 1656 includes a central shaft and a pair of flanges 1657 near the connection to neck 1660. The central shaft may be cylindrical. Hooked ends of flanges 1657 are configured to fit within the grooves 1647 positioned adjacent to sliding channel 1645. A user inserts barb 1656 through oculus 1640 with the central shaft aligned with the oculus and with flanges 1657 aligned with sliding channel 1645. The user then rotates anchor 1650 ninety degrees so that flanges 1657 are aligned with and fit into grooves 1647. As anchor 1650 slides within sliding channel 1645, flanges 1657 engage and are guided by grooves 1647. Grooves 1647 prevent anchor 1650 from rotating when neck 1660 is within sliding channel 1645 and help keep anchor 1650 engaged with sliding channel 1645.

Figure 20:
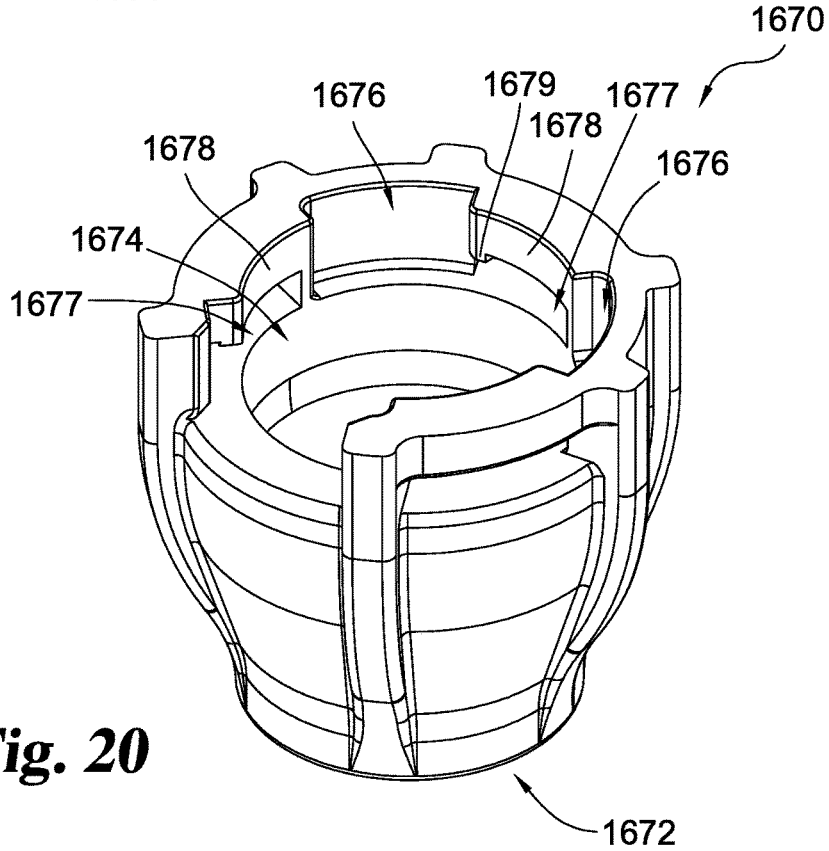
FIG. 20 illustrates a perspective view of a bottom receiver from the anchor of FIG. 18.

A perspective view of bottom receiver 1670 is shown in FIG. 20. Cavity 1674 is partially defined in the interior of bottom receiver 1670 leading to anchor opening 1672 (see FIG. 17). A series of channels 1676 and slots 1677 are positioned along the diameter of bottom receiver 1670. The positioning of channels 1676 corresponds with the position of tabs 1662 of top receiver 1656. Each slot 1677 includes an overhang 1678. One or more overhangs 1678 may include a projection 1679 that can engage a step portion 1665 of tab 1662 to lock top receiver 1655 to bottom receiver 1670.

As shown by FIGS. 19-20, top receiver 1655 and bottom receiver 1670 are two separate pieces that may be connected to form anchor 1650. To attach a resistance component 110 to anchor 1650, an end of resistance component 110 that does not include protruding part 115 is threaded through anchor opening 1672 so that the end of resistance component 110 that includes protruding part 115 is positioned in cavity 1674. Protruding part 115 prevents the adjacent end of resistance component 110 from sliding through anchor opening 1672. After protruding part 115 is positioned in cavity 1674, top receiver 1655 is placed on bottom receiver 1670, by aligning tabs 1662 with channels 1676 and sliding receivers 1655, 1670 together. The receivers 1655, 1670 are then rotated with respect to each other so that projections 1663 of tabs 1662 rotate into slots 1677. Tapered portions 1664 of tabs 1662 assist in allowing tabs 1662 to enter and move past projections 1679 and beneath a respective overhang 1678. Top receiver 1655 is rotated until step portion 1665 aligns with projection 1679. When fully rotated, projections 1679 may snap into step portions 1665, locking top receiver 1655 to bottom receiver 1670 with resistance component secured within anchor 1650.

Although anchor 1650 shows one method of securing a resistance component to handle 1620, in other embodiments, alternative securement methods may be used. For example, an anchor similar to anchor 210 may be used. In other examples, the resistance component may be tied to anchor 1650, a fastener may be used such as a clip, clamp, or anchor plate with holes, or resistance component may be permanently attached to an anchor using a closed loop, adhesive or another suitable method.

Figure 21:
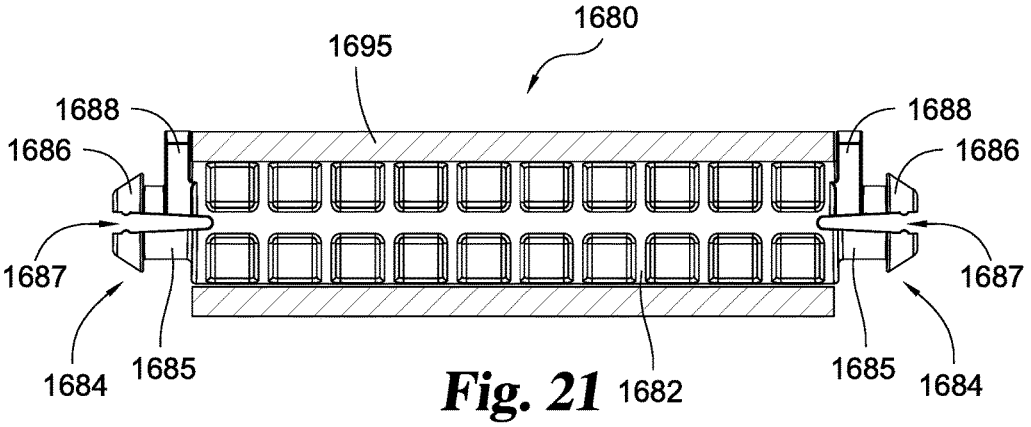
FIG. 21 illustrates a front cross-section view of a grip from the handle system of FIG. 16.
Figure 22:
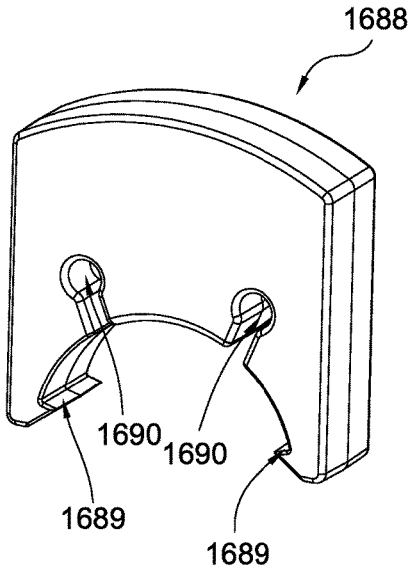
FIG. 22 illustrates a perspective view of a tab from the grip of FIG. 21.

FIG. 21 shows a cross-section of an embodiment of a grip 1680. Grip 1680 includes a core 1682 having two ends 1684. In some embodiments, each end 1684 includes a stem 1685 and a head 1686 that has a larger width than stem 1685. Ends 1684 may be split in half to form a gap 1687 between each half. A tab 1688 can extend from each stem 1685. Tab 1688 may be clipped on to stem 1685 or tab 1688 may be constructed as a unitary piece with stem 1685. In some embodiments, one of the tabs 1688 may be removable from stem 1685 or both tabs 1688 may be removable from stem 1685. As shown in FIG. 22, tab 1688 may include flanges 1689 to help secure tab 1688 to stem 1685. Tab openings 1690 provide tab 1688 with resiliency to expand for removal from stem 1685 or to compress for connection to stem 1685.

A grip overmold 1690 may cover core 1682. In some embodiments, grip overmold 1690 may be rotatable around core 1682. Optionally, grip overmold 1690 may be made of an easy to grip material such as rubber or any other desired composite material. In other embodiments, grip overmold 1690 may be formed from a plastic, wood, or metal. Overmold 1690 may also be textured or contoured to help improve the grip and prevent a user's hand from slipping.

To attach grip 1680 to handle 1620, at least one of the tabs 1688 is removed from stem 1685. Core 1682 is slid within grip overmold 1690 so that grip overmold 1690 surrounds core 1682. Then, each of the ends 1684 is inserted through a respective grip opening 1634 in frame 1625 so that each stem 1685 engages frame 1625 at a grip opening 1634 and head 1686 is positioned within a grip cavity 1636. Gap 1687 allows stem 1685 and head 1686 to be slightly compressed to fit through grip opening 1634 and then rebound to a wider diameter. The uncompressed diameter of head 1686 is greater than the diameter of grip opening 1634, so once head 1686 is inserted through grip opening 1634 it is prevented from being removed from grip opening 1634. Removal of end 1684 from grip opening 1634 requires radial forces to be applied to press the halves of end 1684 together while also pulling end 1684 laterally out of grip opening 1634. After ends 1684 are inserted through a respective grip opening 1634, the additional tab 1688 is clipped onto the stem 1685 that does not have a tab 1688. Connecting a tab 1688 to each stem 1685 helps to prevent grip 1680 from sliding laterally with respect to frame 1625 and prevents core 1682 from rotating.

Figure 23:
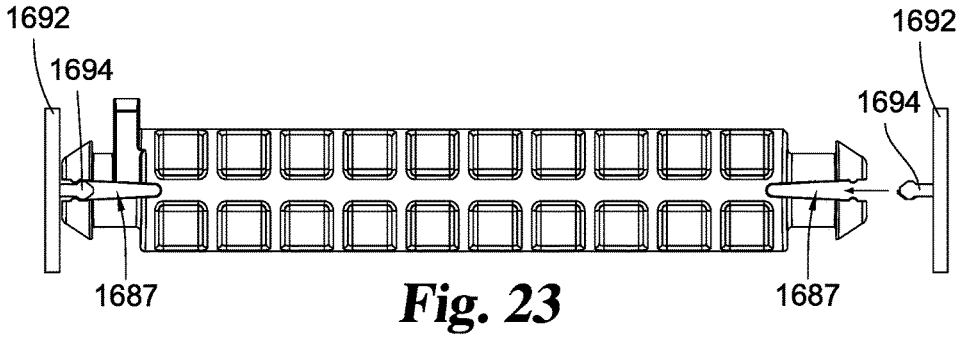
FIG. 23 illustrates a front view of a core from the grip of FIG. 21 with clip locks inserted into gaps of the core.

In some embodiments, a clip lock 1692 may be placed over each grip opening 1634 so that clip lock 1692 rests on ledge 1638 and covers grip cavity 1636. Clip lock 1692 may also assist to prevent accidental release of end 1684 from grip opening 1634. As an example, clip lock 1692 may have an extension 1694 that fits into gap 1687 (see FIG. 23), preventing the halves of end 1684 from being radially compressed, thus preventing end 1684 from being removed from grip opening 1634.

Other embodiments of handle 1620 may include different grip arrangements, and/or may use other suitable attachment methods to attach grip 1680 to frame 1625. For example, the grip may be a unitary structure that is bolted onto frame 1625 or the core may be a bolt and nut arranged within an overmolded portion. In other embodiments, handle 1620 may include an integrally formed grip. The grip may be cylindrical or may have a contoured shape. For example, grip 1680 may include grooves spaced to accommodate a user's fingers or may be textured to reduce slipping.

While various embodiments of the invention have been described, it will be apparent to those of ordinary skill in the art that many more embodiments and implementations are possible within the scope of the invention. Accordingly, the invention is not to be restricted, except as set forth in the following claims.

The invention claimed is:

1. An exercise device comprising:
a handle;
an anchor; and
a resistance component attached to the anchor,
wherein the handle comprises:
a frame defining a length and having opposing sides and a curved portion extending between the sides;
a grip having two ends;
wherein one end is connected to each of the opposing sides of the frame:
an open sliding channel having a width and defined along at least a portion of the length of the frame; and
an oculus having a diameter and defined in the frame,
wherein the diameter of the oculus is greater than the width of the open sliding channel, and wherein the oculus forms one end of the open sliding channel,
wherein the anchor is engaged with the open sliding channel, and
wherein the anchor is configured to pan left and right within the length of the open sliding channel.

2. The exercise device of claim 1,
wherein the anchor includes:
a barb;
connection portion configured to receive an end of the resistance component; and
neck defined between the barb and the connection portion,
wherein the width of the barb is greater than the width of the neck,
wherein the neck is positioned within the open sliding channel and
wherein the width of the neck is smaller than the width of the open sliding channel to allow the anchor to slide within the open sliding channel.

3. The exercise device of claim 1,
wherein the resistance component includes a protruding part at an end of the resistance component;
wherein a diameter of the protruding part is greater than the diameter of the resistance component; and
wherein the protruding part of the resistance component is arranged within the anchor to attach the resistance component to the anchor.

4. The exercise device of claim 2,
wherein the connection portion includes a top receiver and a bottom receiver,
wherein the top receiver is separable from the bottom receiver.

5. The exercise device of claim 4,
wherein the top receiver includes a tab,
wherein the bottom receiver includes:
a receiving channel configured to receive the tab;
a slot radially adjacent to the receiving channel; and
an overhang,
wherein, when the tab is aligned with the receiving channel, the top receiver is separable from the bottom receiver, and
wherein, when the tab is aligned with the slot and the overhang, the top receiver is secured to the bottom receiver.

6. The exercise device of claim 4, further comprising
a groove adjacent to a side of the open sliding channel,
wherein the barb includes a flange, and
wherein the flange is configured to be positioned within the groove when the anchor is engaged with the open sliding channel.

7. The exercise device of claim 1,
wherein the open sliding channel is defined along at least half of the length of the frame, and
wherein the open sliding channel is defined along at least a portion of the curved portion of the frame.

8. The exercise device of claim 1,
wherein the grip is rotatable with respect to the frame.

9. The exercise device of claim 1,
wherein the grip includes:
a grip core including two ends,
wherein the grip core is received through a grip opening defined in each of the opposing sides of the frame; and a grip overmold positioned around the grip core and between the opposing sides of the frame.

10. The exercise device of claim 1, further comprising:

a second anchor attached to the frame;

wherein the second anchor is slidable within the open sliding channel so that the anchor may pan left and right within the length of the channel.

11. The exercise device of claim 1, further comprising a grip axis defined through the grip and an anchor axis defined through the anchor, wherein the anchor is slidable within the open sliding channel so that the angle of the anchor axis, with respect to the grip axis, may be varied.

12. The exercise device of claim 1, wherein the open sliding channel is defined along the entire length of the curved portion.

13. The exercise device of claim 1, further comprising a grip axis defined through the grip and an oculus axis defined through the oculus in the frame, wherein the grip axis is parallel to the oculus axis.

14. The exercise device of claim 13, further comprising an anchor axis defined through the anchor, wherein the anchor is slidable within the open sliding channel so that the angle of the anchor axis with respect to the grip axis may be varied.

* * * * *